US008656987B2

(12) United States Patent
Natali

(10) Patent No.: US 8,656,987 B2
(45) Date of Patent: Feb. 25, 2014

(54) PROCESS FOR PRODUCING HEAT EXCHANGER TUBES AND HEAT EXCHANGER TUBES

(75) Inventor: Gianfranco Natali, Sorengo (CH)

(73) Assignee: Faist Componenti S.p.A., Montone (IT)

( * ) Notice: Subject to any disclaimer, the term of this patent is extended or adjusted under 35 U.S.C. 154(b) by 0 days.

(21) Appl. No.: 13/550,059

(22) Filed: Jul. 16, 2012

(65) Prior Publication Data

US 2012/0312517 A1 Dec. 13, 2012

Related U.S. Application Data

(62) Division of application No. 12/295,660, filed as application No. PCT/IB2007/054033 on Oct. 4, 2007, now Pat. No. 8,220,152.

(30) Foreign Application Priority Data

Oct. 6, 2006 (IT) ..... VR2006A0154

(51) Int. Cl.

| | |
|---|---|
| ***F28F 1/12*** | (2006.01) |
| ***F28F 1/04*** | (2006.01) |
| ***F28F 1/34*** | (2006.01) |
| ***F28D 1/03*** | (2006.01) |

(52) U.S. Cl.

CPC . *F28F 1/045* (2013.01); *F28F 1/34* (2013.01); *F28D 1/035* (2013.01)

USPC ..... 165/177; 165/172

(58) Field of Classification Search

None

See application file for complete search history.

(56) References Cited

U.S. PATENT DOCUMENTS

| | | | | |
|---|---|---|---|---|
| 1,301,608 | A * | 4/1919 | Satz | 165/152 |
| 1,376,882 | A * | 5/1921 | Hromadko | 165/153 |
| 1,417,387 | A * | 5/1922 | Jungerheld | 165/148 |
| 1,790,036 | A | 1/1931 | Wiltse | |
| 2,526,157 | A * | 10/1950 | Ramen | 165/82 |
| 3,554,150 | A * | 1/1971 | Goetschius et al. | 29/890.045 |
| 3,757,855 | A * | 9/1973 | Kun et al. | 165/166 |
| 4,209,064 | A | 6/1980 | Bennett | |
| 4,563,802 | A | 1/1986 | Benteler et al. | |
| 5,441,105 | A | 8/1995 | Brummett et al. | |
| 6,321,835 | B1 * | 11/2001 | Damsohn et al. | 165/159 |
| 6,364,006 | B1 * | 4/2002 | Halt et al. | 165/148 |
| 6,453,989 | B1 * | 9/2002 | Watanabe et al. | 165/177 |
| 6,892,806 | B2 * | 5/2005 | Pantow et al. | 165/179 |
| 6,938,685 | B2 * | 9/2005 | Duerr et al. | 165/148 |
| 2002/0153131 | A1 | 10/2002 | Sugawara et al. | |
| 2004/0182559 | A1 | 9/2004 | Kent et al. | |
| 2005/0161206 | A1 | 7/2005 | Ambrose et al. | |

FOREIGN PATENT DOCUMENTS

| | | | |
|---|---|---|---|
| EP | 1544564 | A | 6/2005 |
| JP | 2000146479 | A | 5/2000 |

* cited by examiner

*Primary Examiner* — Allen Flanigan

(74) *Attorney, Agent, or Firm* — Pearne & Gordon LLP

(57) ABSTRACT

A process for making heat exchanger tubes includes the operating steps of cutting a piece of sheet, subjecting the piece of sheet (3) to a forming step to obtain a plurality of first elements (8, 9) which mirror one another, and bending the piece of sheet (3) to create a tubular element (1) which has two flat walls (4) with the raised elements (8, 9) on them, the flat walls being opposite one another and joined by two connecting walls (5). The first raised elements (8) have an extended shape according to their main direction of extension. The forming step involves making one or more higher second raised elements (9).

13 Claims, 5 Drawing Sheets

PROCESS FOR PRODUCING HEAT EXCHANGER TUBES AND HEAT EXCHANGER TUBES

TECHNICAL FIELD

The present invention relates to a process for making heat exchanger tubes, as well as heat exchanger tubes of the type in which a plurality of tubes carrying a first fluid are positioned parallel with one another in a chamber in which a second fluid flows. In particular, the present invention is intended for shell and tube heat exchangers made of stainless steel with limited thickness.

In particular, the present invention is intended to be applied to heat exchangers in whose tubes exhaust gases pass, for example from engines, and around which a coolant fluid flows.

BACKGROUND ART

At present, this type of heat exchanger has several problems relative to heat exchange efficiency. Firstly, the current multi-tube heat exchangers cannot guarantee the correct flow of the fluid around all of the tubes. Secondly, there may be thermal gradients between the various tubes which have a negative effect on the general efficiency of the heat exchange.

It should also be noticed that no type of existing tube, if used in a heat exchanger, is able to overcome said problems.

DISCLOSURE OF THE INVENTION

The technical purpose which forms the basis of the present invention is to provide a process for making heat exchanger tubes which overcomes the above-mentioned disadvantages.

In particular, the technical purpose of the present invention is to provide a process for making heat exchanger tubes which allows tubes to be made which guarantee optimum heat exchange.

The technical purpose specified and the aims indicated are substantially achieved by a process for making heat exchanger tubes and by a heat exchanger tube as described in the claims herein.

BRIEF DESCRIPTION OF THE DRAWINGS

Further features and advantages of the present invention are more apparent in the detailed description below, with reference to several preferred, non-limiting embodiments of a process for making heat exchanger tubes, illustrated in the accompanying drawings, in which:

FIGS. 1*a* to 5*a* illustrate, in an elevated side view, the sequence of operating steps of FIGS. 1 to 5;

DETAILED DESCRIPTION OF THE PREFERRED EMBODIMENTS OF THE INVENTION

Figure 1:
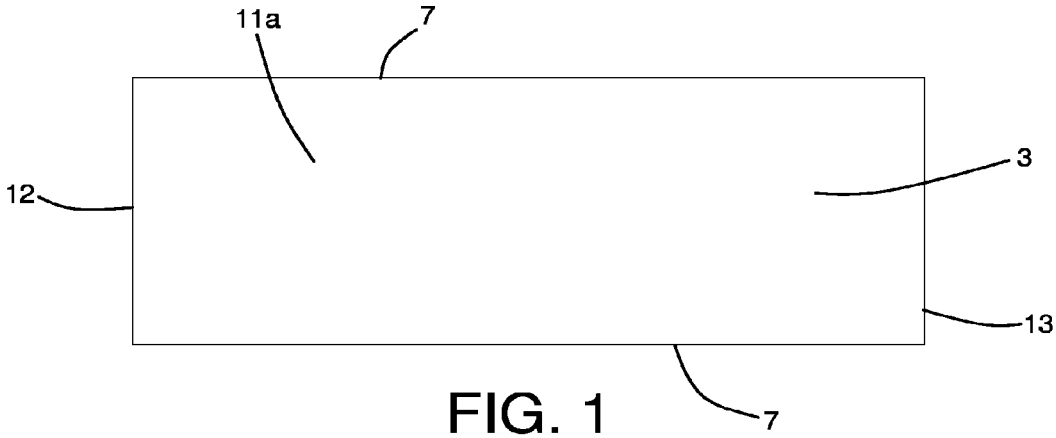
FIGS. 1 to 5 illustrate, in a plan view, a sequence of operating steps for making the tube in accordance with the present invention.

With reference to the accompanying drawings, the numeral 1 denotes as a whole a tube for heat exchangers 2.

In particular, in the embodiment illustrated, the tube 1 consists of a single bent and shaped sheet 3, having two flat walls 4, opposite one another and joined by two connecting walls 5. Each flat wall 4 has a plurality of formed raised elements 8, 9, designed, in practice, as described in more detail below, to space out and maintain in contact with one another two adjacent tubes 1, as well as, in particular first raised elements 8, for suitably conveying and slowing the motion of the fluid to optimise heat exchange. The bent sheet 3 is welded, preferably at the front end, along its lateral edges 7 at one of the connecting walls 5.

In more detail, each flat wall 4 has on its outer face four longitudinal rows of first raised elements 8, parallel with a tube 1 central axis (usually there are at least two).

The first raised elements 8 positioned on a flat wall 4 equal in number and mirror those positioned on the other flat wall, relative to a plane of symmetry passing through the longitudinal central axis of the tube 1 and parallel with the flat walls 4.

Figure 7:
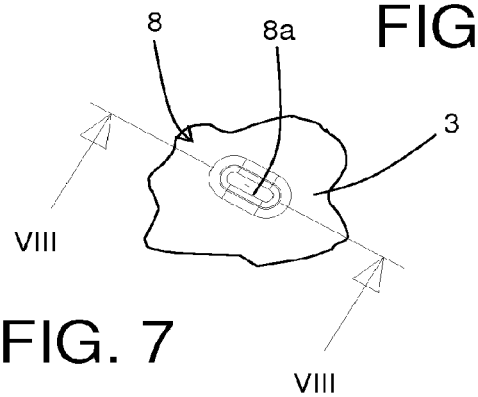
FIG. 7 shows a detail of FIG. 2.
Figure 8:
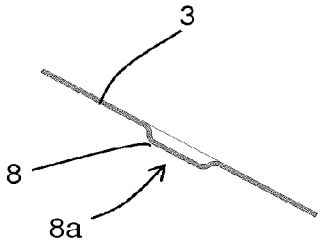
FIG. 8 shows the detail of FIG. 7 according to the cross-section VIII-VIII.
Figure 12:
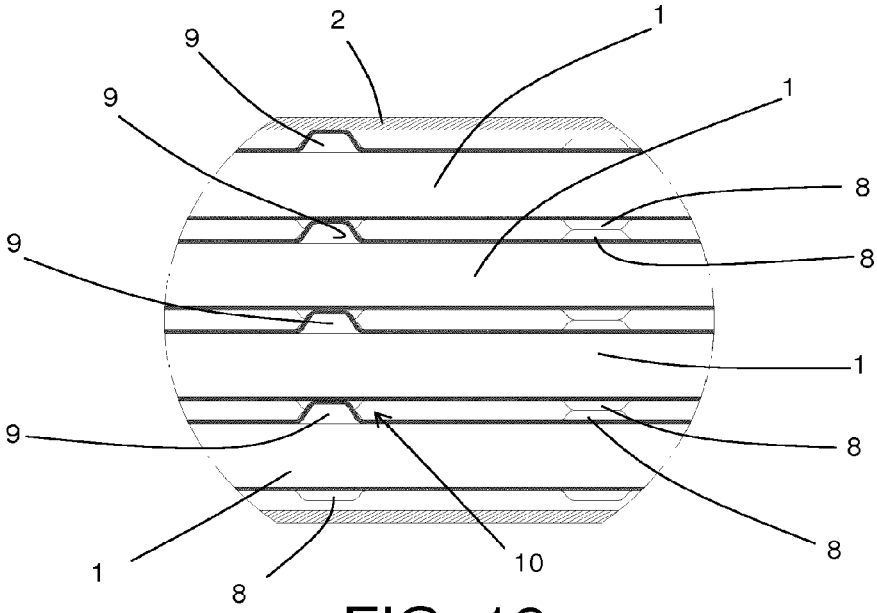
FIG. 12 is an enlarged view of the detail XII-XII of FIG. 11.

As FIGS. 7 and 8 show more clearly (illustrating an enlarged first raised element 8), each first raised element 8 has a flat upper face 8*a*, having an extended preferably elliptical shape, and designed to connect with a first raised element 8 of an adjacent tube 1 (FIG. 12).

Figure 4:
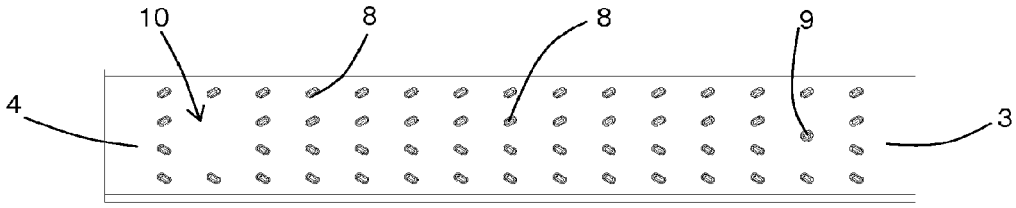
Figure 5:
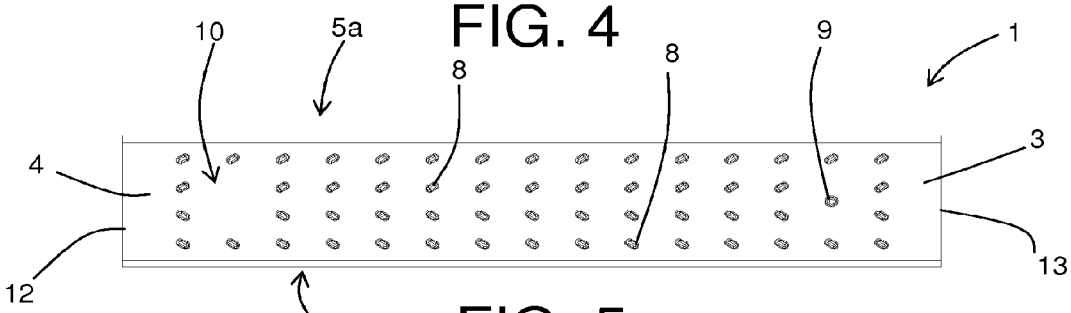

With reference to FIGS. 4 and 5, it should be noticed that the main directions of extension (greater axis of the ellipse they form) of the upper faces 8*a* of the first raised elements 8 of the rows closest to a first connecting wall 5*a* are set at an angle to the longitudinal direction of the tube 1 and to a direction perpendicular to it. In turn, the main directions of extension of the upper faces 8*a* of the first raised elements 8 of the rows closest to the second connecting wall 5*b*, are set at an angle both to the longitudinal direction of the tube 1 and to a direction perpendicular to it, but on the opposite side relative to upper faces 8*a* of the raised elements 8 of the rows closest to the first connecting wall 5*a*.

Figure 13:
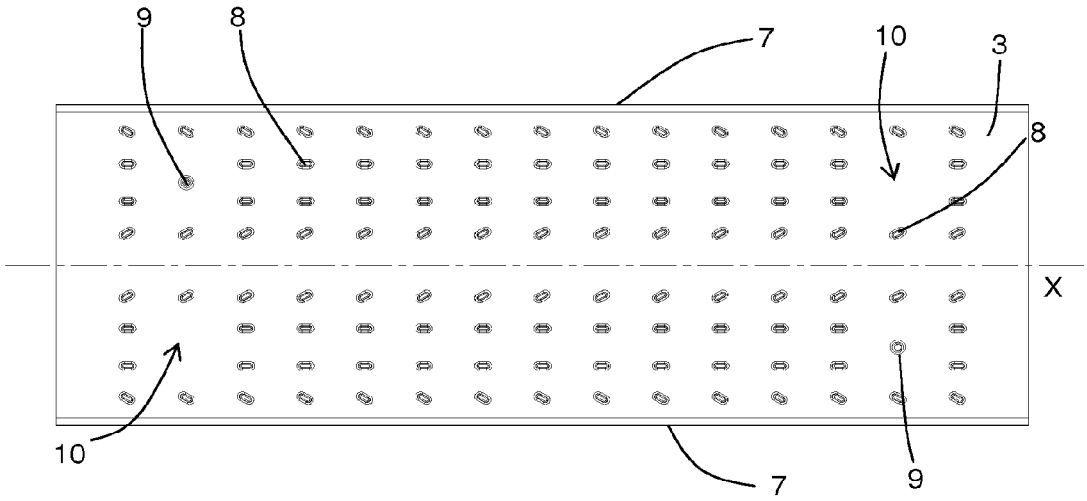
FIG. 13 illustrates, in a plan view, a sequence of operating steps for making the tube in accordance with an alternative embodiment of the present invention.
Figure 14:
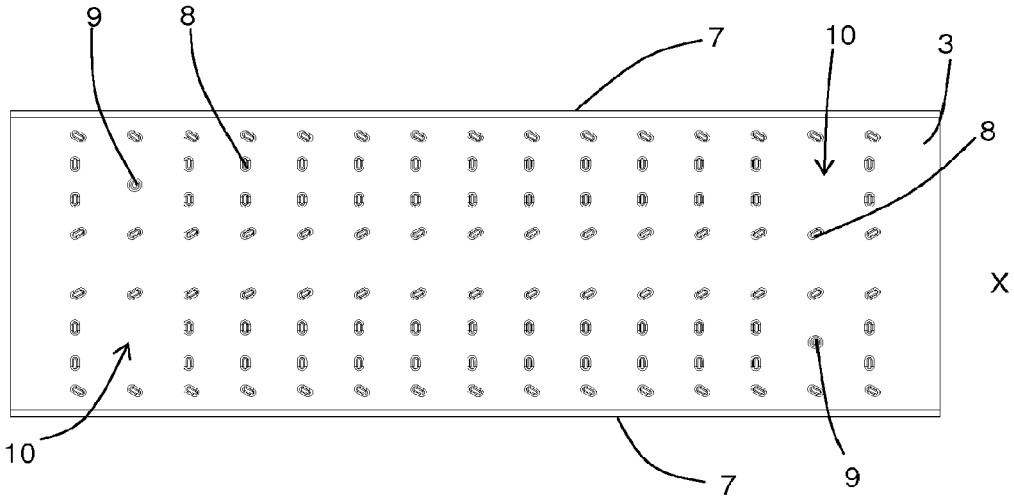
FIG. 14 illustrates, in a plan view, a sequence of operating steps for making the tube in accordance with another alternative embodiment of the present invention.

There are also other embodiments (FIG. 13 and FIG. 14) in which the first raised elements 8 of one or more central rows are positioned with their main direction of extension parallel with or perpendicular to the longitudinal direction of the tube 1 (for example, embodiments in which on each flat wall 4 there are three rows of first raised elements 8).

Figure 2:
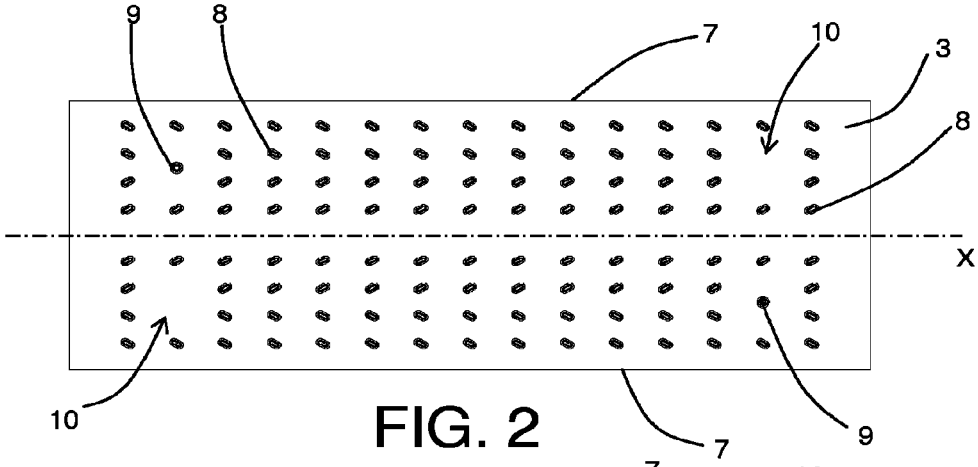
Figure 3:
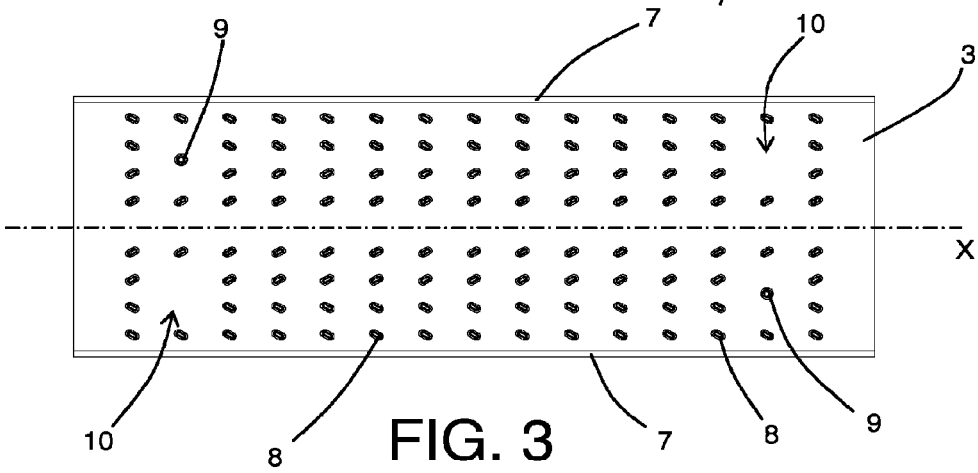
Figure 9:
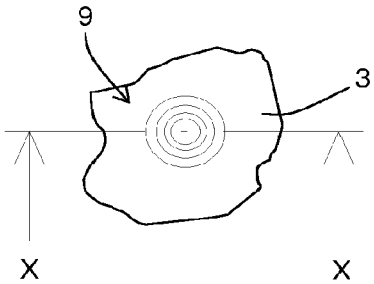
FIG. 9 illustrates another detail of FIG. 2.
Figure 10:
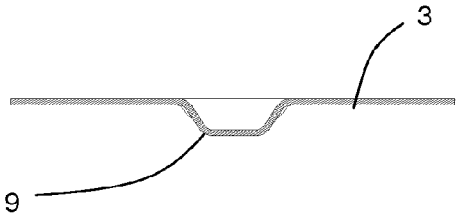
FIG. 10 shows the detail of FIG. 9 according to the cross-section X-X.
Figure 11:
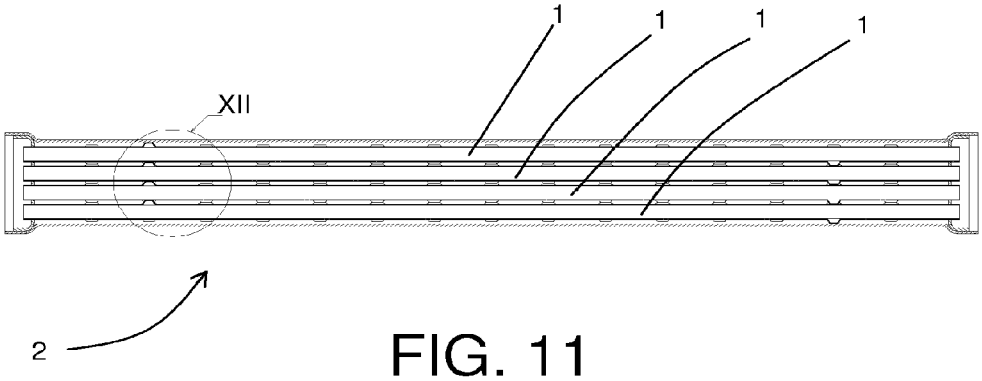
FIG. 11 is a central lateral section of a heat exchanger made with tubes made in accordance with the present invention.

Each flat wall 4 preferably has at least one second raised element 9 higher than the first raised element 8 (FIGS. 9 and 10). At the same time, advantageously, the portion 10 of a flat wall 4 which, relative to a plane of symmetry passing through the central axis of the tube and parallel with the flat walls 4, mirrors a second raised element 9 positioned on the other flat wall 4, is made smooth and without any type of raised element (FIGS. 2 and 3).

The second raised element 9 preferably projects from its flat wall 4, by a height equal to the sum of the projections of the pairs of first raised elements 8 so as to make contact with the respective portion 10 of a flat wall 4 belonging to an adjacent tube (FIG. 12).

When the tubes are mounted in a shell and tube heat exchanger, in accordance with the present invention each tube 1 is in contact with the tubes adjacent to it, and in particular the first raised elements 8 of one tube 1 rest against the first raised elements 8 of the tubes adjacent to it, and the second raised elements 9 of one tube are in contact with the flat portions 10 of the tubes adjacent to it (FIG. 12).

As regards the process for obtaining tubes 1 which is the subject matter of the present invention, in accordance with a preferred embodiment, the tube 1 is obtained by means of an initial step in which a substantially rectangular piece of sheet 3 is cut, preferably from a stainless steel plate between 0.1 and 1 mm thick, preferably 0.4 mm.

Figure 1A:
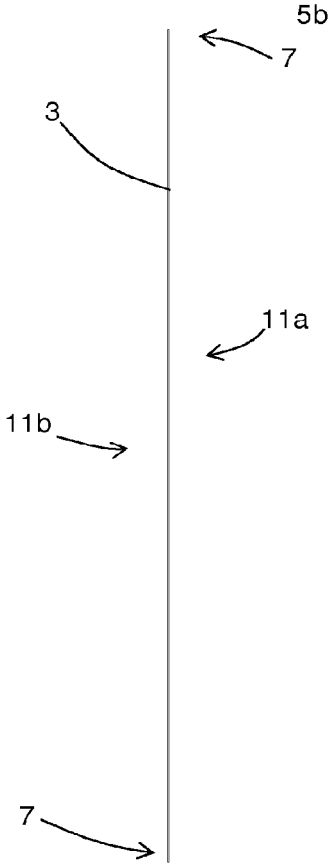

The sheet 3 has a first main face 11*a*, and a second main face 11*b*, a front edge 12, a rear edge 13 and two lateral edges 7 (FIGS. 1 and 1*a*).

Figure 2A:
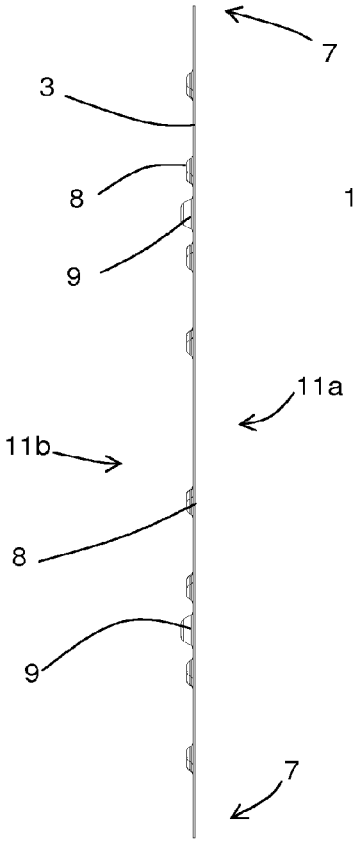

Then, the piece of sheet 3 is subjected to a forming step to obtain a plurality of elements 8, 9 raised relative to the second face 11*b* (FIGS. 2 and 2*a*).

The step of forming the raised elements 8, 9 is only carried out at zones of the sheet 3 designed to constitute the flat walls 4.

In detail, the forming step involves the creation of two groups of raised elements 8, 9 positioned respectively in two longitudinal bands of the piece of sheet 3, positioned so that they mirror one another relative to a central axis X of the piece of sheet 3 parallel with the lateral walls 7 (FIGS. 2 and 3).

At least two longitudinal rows of the first raised elements 8 are made on each longitudinal band, parallel with the central axis X.

In this way, the first raised elements 8 are positioned in such a way that they mirror one another relative to the central axis X of the piece of sheet 3.

Therefore, as described above, the first raised elements 8 of the rows closest to the central axis X are made in such a way that their main direction of extension (greater axis of the ellipse formed by their upper face 8*a*) is set at an angle to the central axis X and to a direction perpendicular to it. In turn, the first raised elements 8 of the rows closest to the lateral edges 7 are made in such a way that their main direction of extension is set at an angle to the central axis X and to a direction perpendicular to it, on the opposite side relative to the first raised elements 8 of the rows closest to the axis X.

In some cases, when each flat wall 4 has three or more parallel rows of first raised elements 8, those of the central rows of each longitudinal band of the piece of sheet 3 may instead be made in such a way that their main direction of extension is parallel with or perpendicular to the central axis X, to create, with the adjacent elements, channels for the fluid which, in practice, will envelope the tubes 1. In particular, if the central elements are parallel with the central axis X, said channels will converge from the periphery to the centre of the tube which they will then follow longitudinally (similarly to what happens in the case illustrated in the accompanying drawings). In contrast, if the elements are positioned perpendicularly, the channels will pass across the tube 1 transversally.

The forming step may also involve the production of at least one second raised element 9 as described above.

The forming step is followed by a step of bending the piece of sheet 3 parallel with the lateral edges 7, to create a tubular element whose outer surface consists of the second face 11*b* and which has two flat walls 4 opposite one another and joined by the connecting walls 5.

This bending step is preferably carried out by placing the lateral edges 7 opposite one another in such a way that the first and second faces 11*a*, 11*b* at one lateral edge 7, form a continuation respectively of the first and second faces 11*a*, 11*b* at the other lateral edge 7.

Figure 3A:
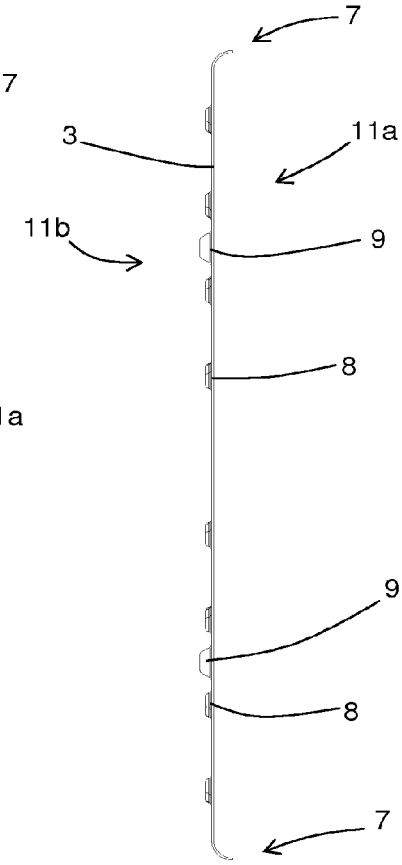

In more detail, the bending step involves a first sub-step of partly bending the piece of sheet 3 at the lateral edges 7 so that, when the bending step is complete, the two portions bent in this way form one of the connecting walls 5 of the tubular element 1 (FIGS. 3 and 3*a*).

Advantageously, the first partial bending sub-step is carried out simultaneously with the step of forming the raised elements 8, 9.

Figure 4A:
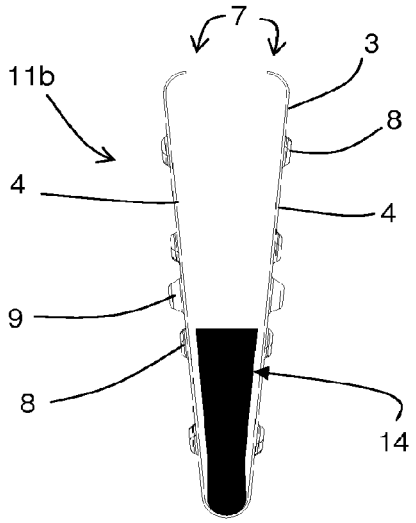

Then a second partial bending sub-step is carried out, partly bending the piece of sheet 3 around a template 14 positioned at an intermediate portion of the first face 11*a* equidistant from the lateral edges 7 (FIGS. 4 and 4*a*).

Figure 5A:
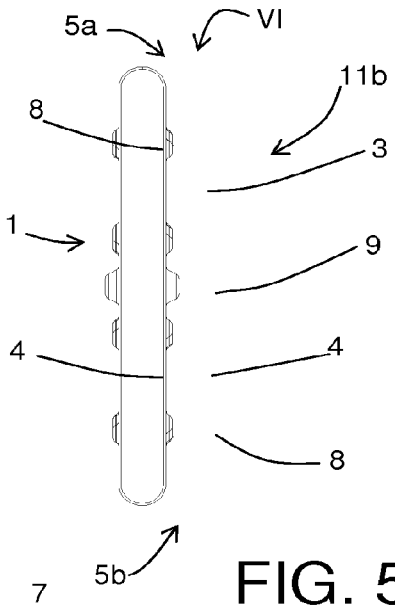

After the partial bending sub-step, there is a template 14 removal sub-step and a bending completion sub-step during which the lateral edges 7 are placed opposite one another (FIGS. 5 and 5*a*) and the tubular element is gauged.

Figure 6:
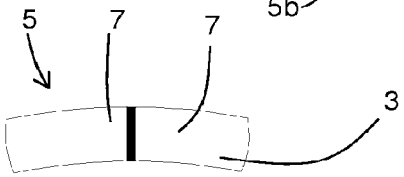
FIG. 6 is an enlarged view of the detail VI of FIG. 5*a;*

Finally, the front end lateral edges 7 are welded, preferably with laser welding, to close the tubular element 1 (FIG. 6).

The present invention brings important advantages.

The tubes disclosed guarantee optimum heat exchange thanks to the angled arrangement of the first, outer raised elements, which create channels for the fluid and suitably guide and slow its flow.

Moreover, thanks to the contact between the tubes guaranteed by the raised elements, there is an equalisation of the temperature in the tube bundle which guarantees improved heat exchange compared with conventional exchangers.

It should also be noticed that the present invention is relatively easy to produce and even the cost linked to implementation of the invention is not very high.

The invention described above may be modified and adapted in several ways without thereby departing from the scope of the inventive concept.

All details of the invention may be substituted by other technically equivalent elements and, in practice, all of the materials used, as well as the shapes and dimensions of the various components, may be any according to requirements.

The invention claimed is:

1. A heat exchanger tube, characterised in that it consists of bent, shaped and welded sheet (3), and in that it has two flat walls (4) opposite one another and joined by two connecting walls (5), each of the flat walls (4) having at least two formed parallel longitudinal rows of first raised elements (8, 9) designed, in practice, to space out and maintain in contact with one another two adjacent tubes (1), each first raised element having a main direction of extension, also being characterised in that the first raised elements (8) positioned on one flat wall (4) mirror those positioned on the other flat wall (4), relative to a plane of symmetry parallel with the flat walls (4) and passing through a longitudinal central axis of the tube, and in that, on each flat wall (4), the main direction of extension of the first raised elements (8) of one or more rows closest to a first connecting wall (5*a*) is set at an angle both to the longitudinal direction of the tube (1) and to a direction perpendicular to it, and the main direction of extension of the first raised elements (8) of one or more rows closest to the other connecting wall (5) is set at an angle both to the longitudinal direction of the tube (1) and to a direction perpendicular to it, on the opposite side relative to the direction of extension of the first raised elements (8) of the row closest to the first connecting wall (5*a*), and wherein at least one flat wall (4) has at least one higher second raised element (9); a portion (10) of one flat wall (4) which mirrors a second raised element (9) located on the other flat wall (4), relative to the plane of symmetry, being without raised elements.

2. The tube according to claim 1, characterised in that each flat wall (4) has on its outer face at least three longitudinal rows of first raised elements (8), parallel with a tube (1) central axis.

3. The tube according to claim 1, characterised in that the sum of the projections, relative to the respective flat wall (4), of each pair of first raised elements (8) which mirror one another, is the same.

4. The tube according to claim 1, characterised in that each first raised element (8) has a flat upper face (8*a*).

5. The tube according to claim 4, characterised in that each first raised element (8) has an elliptical upper face (8*a*).

6. The tube according to claim 1, characterised in that each flat wall (4) has on its outer face at least three longitudinal rows of first raised elements (8), parallel with a central axis of the tube (1).

7. The tube according to claim 6, characterised in that the main direction of extension of the first raised elements (8) of at least a central row of each flat wall (4) is parallel with or perpendicular to the longitudinal direction of the tube (1).

8. The tube according to claim 3, characterised in that at least one flat wall (4) has at least one higher second raised element (9) and in that the second raised element (9) has a projection relative to its flat wall (4), equal to the sum of the projections of the pairs of first raised elements (8).

9. The tube according to claim 1, characterised in that the bent sheet (3) is welded at the front end along its lateral edges (7) at one of the connecting walls (5).

10. The tube according to claim 1, characterised in that the sheet (3) consists of stainless steel and is between 0.1 and 1 mm thick.

11. A heat exchanger characterised in that it comprises a plurality of tubes (1) made in accordance with claim 1, the tubes being positioned with the relative flat walls (4) parallel.

12. The heat exchanger according to claim 11, characterised in that the raised elements (8, 9) of one tube (1) are in contact with the adjacent tube (1).

13. The heat exchanger according to claim 12, characterised in that at least the first raised elements (8) of one tube (1) are in contact with the first raised elements (8) of the adjacent tube (1).

* * * * *